US006719254B1

(12) United States Patent
Speiser

(10) Patent No.: US 6,719,254 B1
(45) Date of Patent: Apr. 13, 2004

(54) ARTICLE HOLDER

(76) Inventor: Beryl Speiser, 7254 SE. Watkins Rd., Lawson, MO (US) 64062

( * ) Notice: Subject to any disclaimer, the term of this patent is extended or adjusted under 35 U.S.C. 154(b) by 0 days.

(21) Appl. No.: 10/314,097

(22) Filed: Dec. 9, 2002

(51) Int. Cl.[7] ..... A47K 1/08
(52) U.S. Cl. ..... 248/311.2; 248/315
(58) Field of Search ..... 248/311.2, 314, 248/315, 224.8, 222.41, 221.12, 301, 304, 222.51

(56) References Cited

U.S. PATENT DOCUMENTS

| | | | | | |
|---|---|---|---|---|---|
| 400,251 | A | * | 3/1889 | Reed | 73/427 |
| 2,277,738 | A | * | 3/1942 | Wilkinson | 210/249 |
| 3,314,635 | A | * | 4/1967 | Frye | 248/311.2 |
| 3,552,612 | A | * | 1/1971 | Greis | 294/87.28 |
| 4,312,465 | A | | 1/1982 | Sinkhorn et al. | |
| 4,386,753 | A | * | 6/1983 | Smith | 248/210 |
| 4,799,638 | A | * | 1/1989 | Allen | 248/311.2 |
| 4,978,094 | A | * | 12/1990 | Ford | 248/261 |
| 5,129,615 | A | * | 7/1992 | Strauss | 248/311.2 |
| 5,377,558 | A | | 1/1995 | Harris | |
| 5,522,527 | A | | 6/1996 | Tsai | |
| 5,752,687 | A | | 5/1998 | Lynch | |
| 6,390,427 | B1 | * | 5/2002 | McConnell et al. | 248/231.61 |

* cited by examiner

*Primary Examiner*—Ramon O. Ramirez
*Assistant Examiner*—Amy J. Sterling

(57) ABSTRACT

An article holder includes a device that is removably securable to a pair of mounting bolts, which secure a handle mounting to a bicycle. The device includes a bracket having a generally planar configuration and having an upper edge, a lower edge, a first side edge and a second side edge. A pair of arms is attached to the first side edge. The arms are spaced from each other and each has a free end having one of a pair of protruding members attached thereto. Each of the protruding members generally extends toward each other. The protruding members are positioned such that each of the mounting bolts may be removably extended through one of the protruding members. A cup support is removably attachable to the bracket.

10 Claims, 4 Drawing Sheets

ARTICLE HOLDER

BACKGROUND OF THE INVENTION

1. Field of the Invention

The present invention relates to article holders and more particularly pertains to a new article holder for providing a user with a product that could be used to stabilize and hold a motorcyclist's beverage container or other items while traveling.

2. Description of the Prior Art

The use of article holders is known in the prior art. U.S. Pat. No. 5,752,687 describes an article holder with a lid retainer. Another type of article holder is U.S. Pat. No. 4,312,465 that describes a handlebar mounted can-holding device, which attaches to a motorcycle or bicycle handlebar to hold a beverage can. U.S. Pat. No. 5,377,558 describes a protective device for covering brackets on motorcycle handlebars. U.S. Pat. No. 5,522,527 describes a beverage container-fixing device for a bicycle.

While these devices fulfill their respective, particular objectives and requirements, the need remains for a device that includes a cup support or a clip support that can be quickly and easily installed or removed from the handles of a motorcycle.

SUMMARY OF THE INVENTION

The needs presented above are met by providing a new article holder that would keep the beverage or other items safe and stable while riding so it is readily accessible when needed.

Another object of the present invention is to provide a new article holder that would be easy to install and remove from the handlebars of the motorcycle.

To this end, the present invention generally comprises an article holding device, which is removably securable to a pair of mounting bolts, which secure a handle mounting to a bicycle. The device includes a bracket having a generally planar configuration and having an upper edge, a lower edge, a first side edge and a second side edge. A pair of arms is attached to the first side edge. The arms are spaced from each other and each has a free end having one of a pair of protruding members attached thereto. Each of the protruding members generally extends toward each other. The protruding members are positioned such that each of the mounting bolts may be removably extended through one of the protruding members. A cup support is removably attachable to the bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
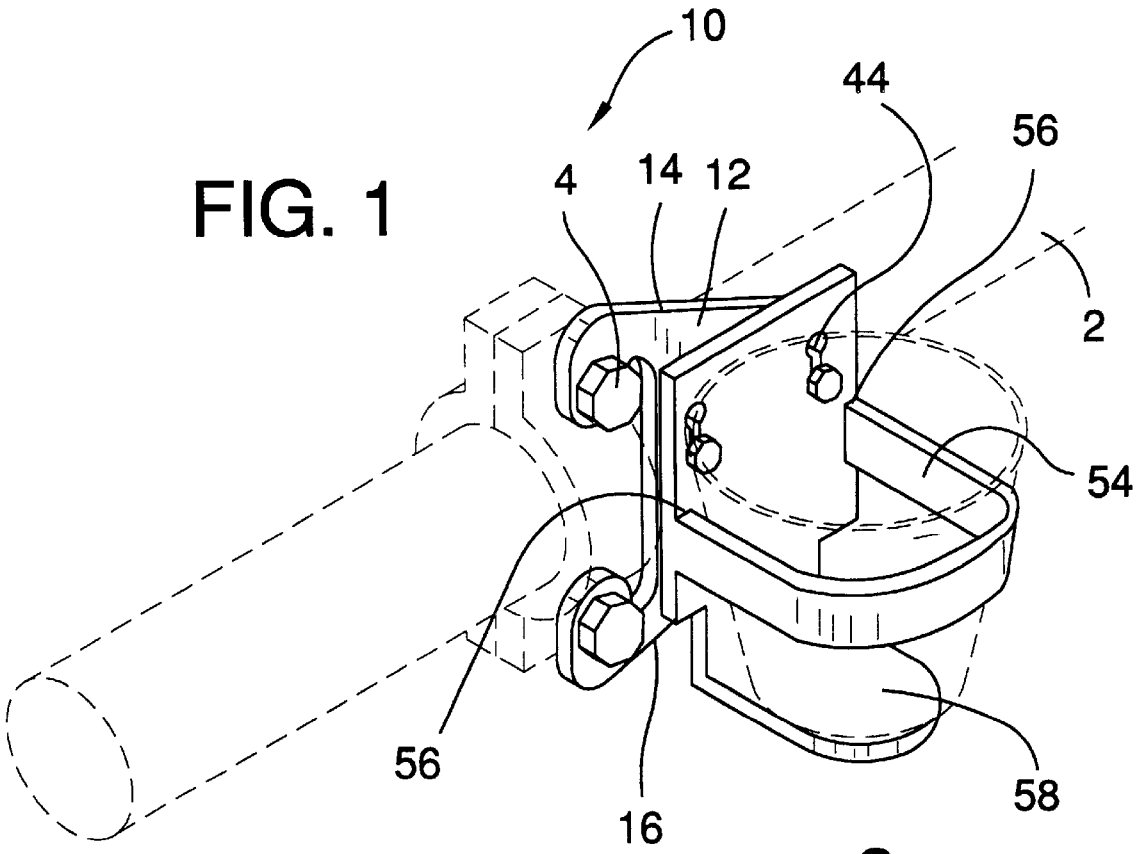
FIG. 1 is a perspective view of an article holder according to the present invention.
Figure 2:
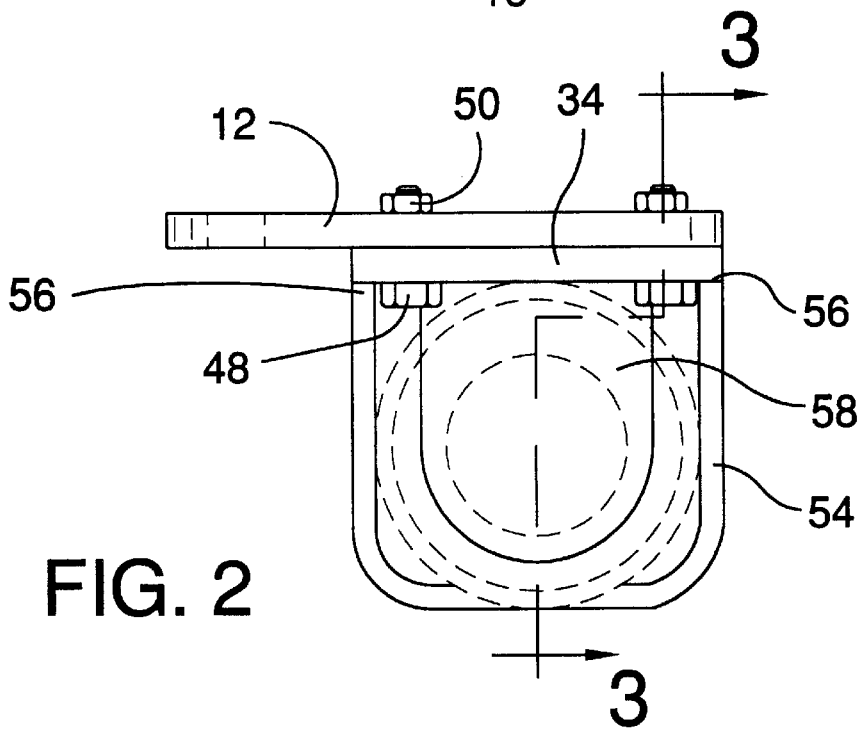
FIG. 2 is a top view of the present invention.
Figure 3:
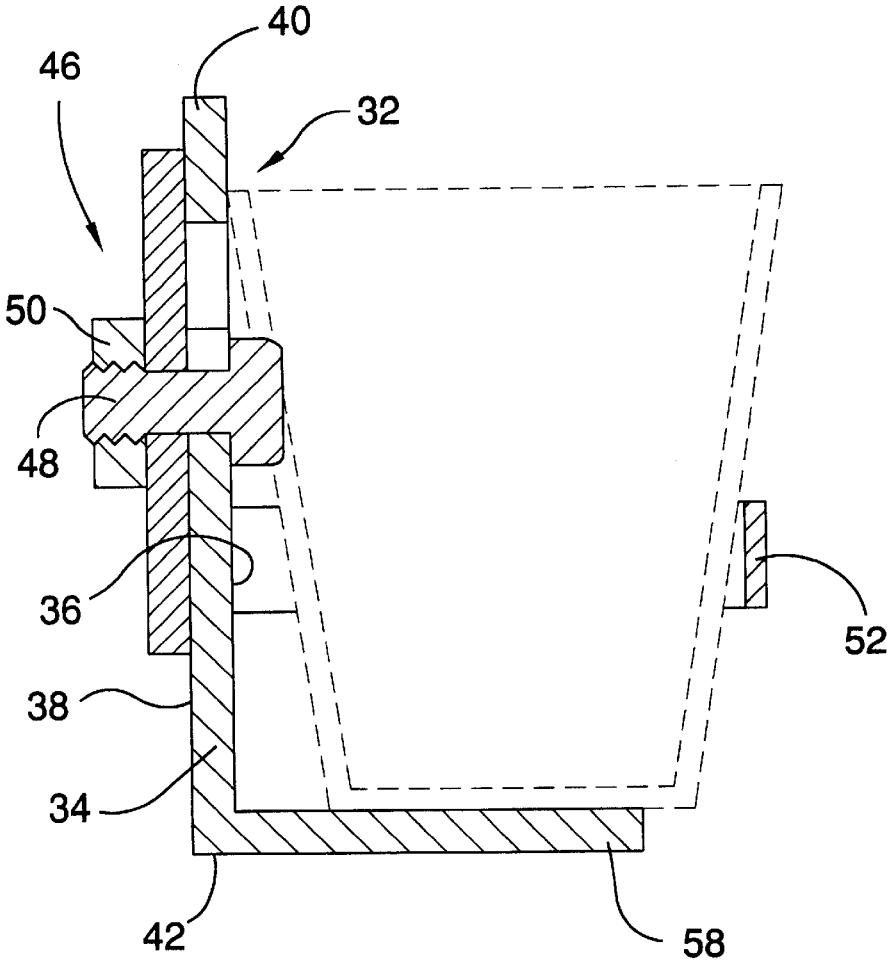
FIG. 3 is a cross-sectional view of the present invention taken along the line 3—3 of FIG. 2 of the present invention.

With reference now to the drawings, and in particular to FIGS. 1 through 4 thereof, a new article holder embodying the principles and concepts of the present invention and generally designated by the reference numeral 10 will be described.

Figure 4:
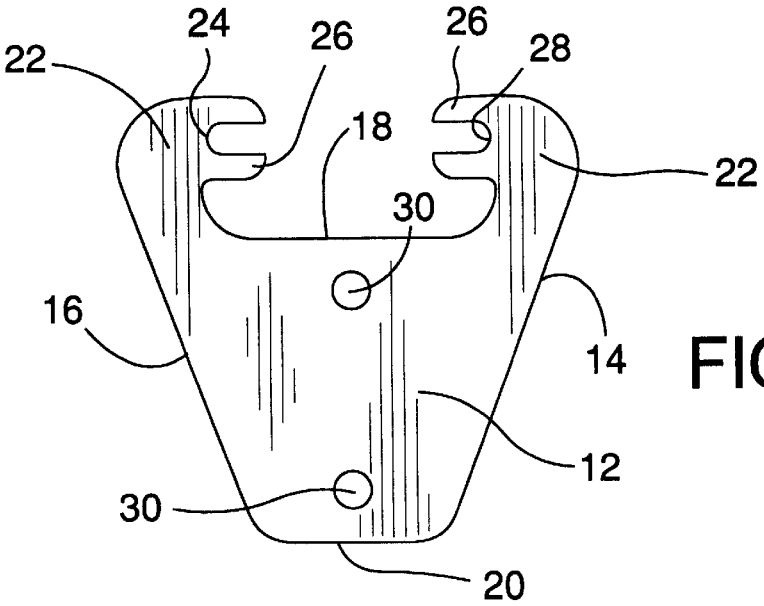
FIG. 4 is a front view of the present invention.
Figure 5:
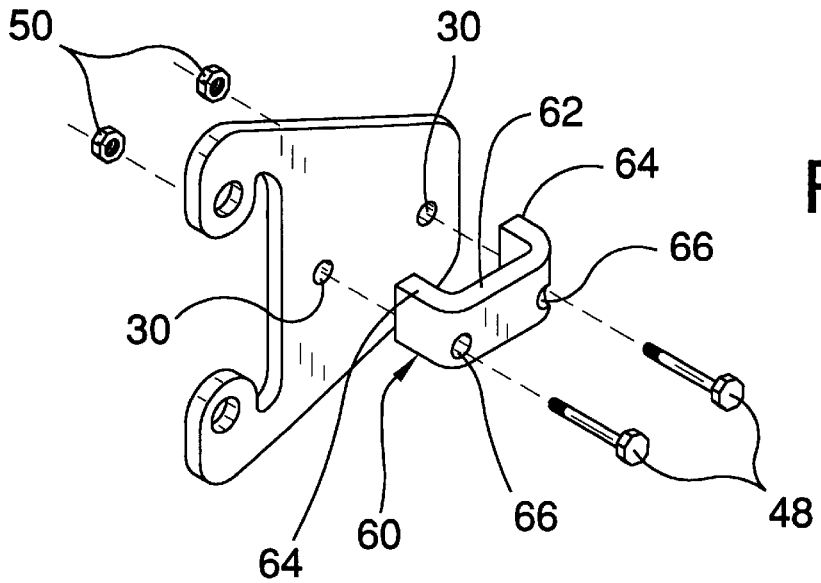
FIG. 5 is a perspective view of the present invention.
Figure 8:
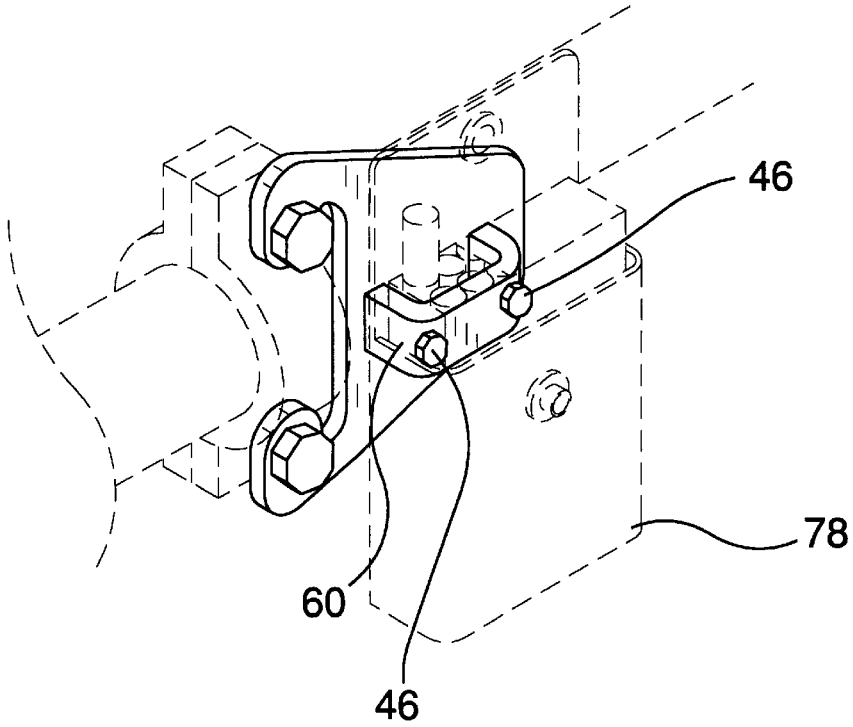
FIG. 8 is a perspective environmental view of the present invention.
Figure 6:
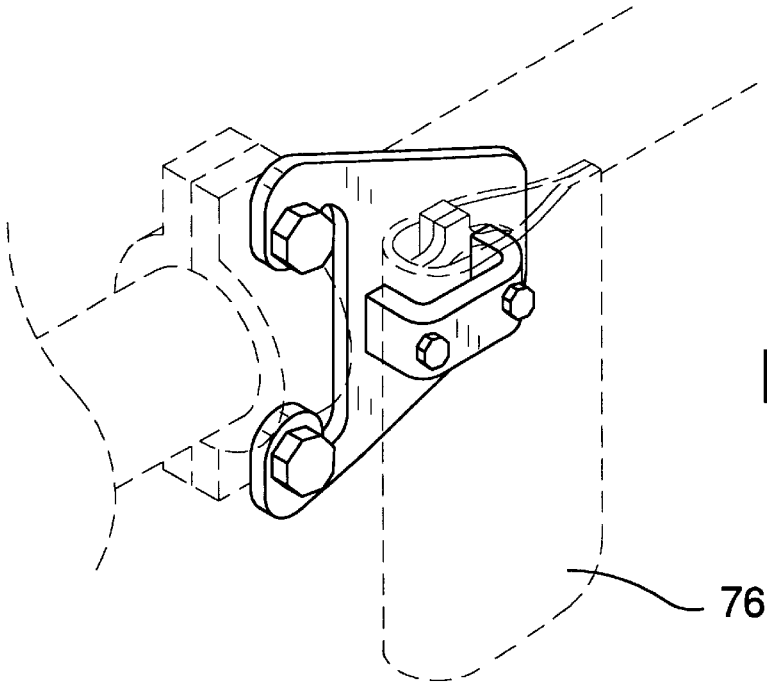
FIG. 6 is a perspective environmental view of the present invention.
Figure 7:
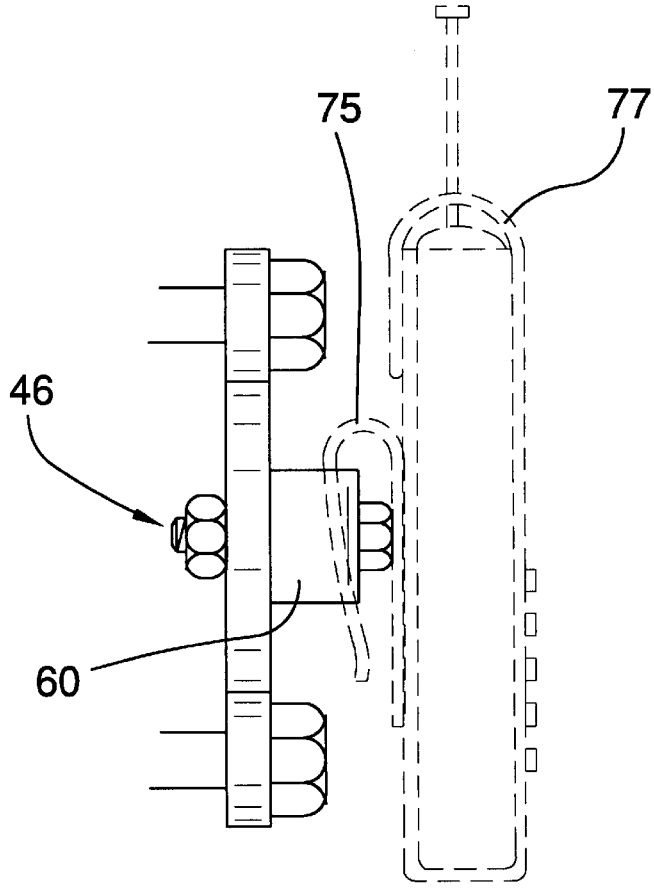
FIG. 7 is a side environmental view of the present invention.

As best illustrated in FIGS. 1 through 4, article holder 10 generally comprises a article holding device for removably securing to a handle mounting 2 of a bicycle 4 (either a conventional bicycle or a motorcycle). Such handle mountings 2 typically include a pair of mounting bolts 4 which are generally co-planar. The device 10 comprises a bracket 12 having a generally planar configuration and has an upper edge 14, a lower edge 16, a first side edge 18 and a second side edge 20. A pair of arms 22 is attached to the first side edge 18. The arms 22 are spaced from each other. Each of the arms 22 has a free end 24. Each of a pair protruding members 26 is attached to one of the arms 22. The protruding members 26 are positioned adjacent to the free ends 24 of the arms 22. The protruding members 26 generally extend toward each other. The protruding members 26 are positioned such that each of the mounting bolts 4 may be removably extended through one of the protruding members 26. This can be accomplished by extending the mounting bolts 4 directly through the protruding members 26 or the protruding members 26 may have indentations 28 in them as shown in FIG. 4. In that case the bolts 4 may be placed in the indentations 28. The bracket 12 has a pair of openings 30 extending therethrough. The openings 30 are generally positioned along a horizontal line extending between the first 18 and second 20 side edges.

A cup support 32 is removably attachable to the bracket 12. The cup support 32 includes a first panel 34 having a front side 36, a back side 38, a top edge 40 and a bottom edge 42. The first panel 34 has a pair of holes 44 extending therethrough. Each of the holes 44 is alignable with one of the openings 30 in the bracket 12. A pair of securing members 46 releasably secures the first panel 34 to the bracket 12. Each of the securing members 46 may comprise a bolt 48 extending through an aligned pair of holes 44 and openings 30 and a nut 50 for securing the bolt 48 in position. A loop 52 is attached to the front side 36 of the first panel 34. The loop 52 includes an elongate member 54 having a pair of ends 56. Each of the ends 56 is attached to the front side 36 and is spaced from each other such that the elongate member 54 forms the loop 52. The loop 52 lies in a plane orientated generally perpendicular to the first panel 34. A second panel 58 is attached to and extends along a length of the bottom edge 42 of the first panel 34. The second panel 58 is orientated generally perpendicular the first panel 34 and positioned below the loop 52.

A clip support 60 is removably attached to the bracket 12 in place of the cup support 32. The clip support 60 is adapted for receiving a clip 75 from holders including, for example, sunglass holders 76, cell phone holders 77 and cigarette holders 78. The clip support 60 includes a central portion 62 and a pair of legs 64 being attached to and extending away from the central portion 62. The clip support 60 has a pair of apertures 66 extending therethrough. Each of the apertures 66 is adapted for receiving one of the securing members 46 for releasably attaching the clip support 60 to the bracket 12 so that the legs 64 extend away from bracket 12. Ideally, the apertures 66 extend through the central portion 62 and through a length of each of the legs 64. The clip 75 from a holder may be extended between the central portion 62 and the bracket 12. It is preferred that the device 10 includes the cup support 32 and the clip support 60 so that they may be interchanged depending on the need of the user.

In use, bracket 12 is attached to the mounting bolts 4 on the handle 2. The bracket 12 holds the device so that the second panel 58 is in a generally horizontal plane. A cup is positioned in the loop 52 and is supported by the loop 52 and the second panel 58. When not in use, the cup support may be removed from the bracket 12, or the bracket 12 from the mounting bolts 4. In this manner a person riding a motorcycle or bicycle has a method for holding a cup, bottle or other container.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A article holding device which may be removably secured to a handle mounting of a bicycle, the handle mounting including a pair of mounting bolts which are generally co-planar, said device comprising:

a bracket having a generally planar configuration and having an upper edge, a lower edge, a first side edge and a second side edge, a pair of arms being attached to said first side edge, said arms being spaced from each other, each of said arms having a free end, each of a pair protruding members being attached to one of said arms, each of said protruding members being positioned adjacent to said free ends of said arms, said protruding members generally extending toward each other, said protruding members being positioned such that each of the mounting bolts may be removably extended through one of the protruding members; and a cup support being removably attachable to said bracket.

2. The article holding device as in claim 1, wherein said cup support includes a first panel having a front side, a back side, a top edge and a bottom edge, a loop being attached to said front side of said first panel.

3. The article holding device as in claim 2, wherein said loop includes an elongate member having a pair of ends, each of said ends being attached to said front side and being spaced from each other such that said elongate member forms said loop, said loop lying in a plane orientated generally perpendicular to said first panel.

4. The article holding device as in claim 2, wherein said first panel has a pair of holes extending therethrough, each of said holes being alignable with one of a pair of openings in said bracket, said openings being generally positioned along a horizontal line extending between said first and second side edges, a pair of securing members releasably secure said first panel to said bracket.

5. The article holding device as in claim 4, wherein each of said securing members comprises a bolt extending through an aligned pair of holes and openings and a nut for securing said bolt.

6. The article holding device as in claim 2, further including a second panel being attached to and extending along a length of said bottom edge of said first panel, said second panel being orientated generally perpendicular said first panel and positioned below said loop.

7. The article holding device as in claim 1, further including a clip support, or clip support.

8. The article holding device as in claim 7, wherein said clip support includes a central portion and a pair of legs being attached to and extending away from said central portion, said clip support having a pair of apertures extending therethrough, each of a pair of securing members being releasably extended through one of said apertures and into a pair of openings in said bracket, wherein each of the apertures is adapted for receiving one of the securing members for releasably attaching the clip support to the bracket so that the legs extend away from bracket.

9. The article holding device as in claim 8, wherein said apertures extend through said central portion and through a length of each of said legs.

10. A article holding device which may be removably secured to a handle mounting of a bicycle, the handle mounting including a pair of mounting bolts which are generally co-planar, said device comprising:

a bracket having a generally planar configuration and having an upper edge, a lower edge, a first side edge and a second side edge, a pair of arms being attached to said first side edge, said arms being spaced from each other, each of said arms having a free end, each of a pair protruding members being attached to one of said arms, each of said protruding members being positioned adjacent to said free ends of said arms, said protruding members generally extending toward each other, said protruding members being positioned such that each of the mounting bolts may be removably extended through one of the protruding members, said bracket having a pair of openings extending therethrough, said openings being generally positioned along a horizontal line extending between said first and second side edges;

a cup support being removably attachable to said bracket, said cup support including;

a first panel having a front side, a back side, a top edge and a bottom edge, said first panel having a pair of holes extending therethrough, each of said holes being alignable with one of said openings in said bracket;

a pair of securing members releasably secure said first panel to said bracket, each of said securing members comprising a bolt extending through an aligned pair of holes and openings and a nut for securing said bolt;

a loop being attached to said front side of said first panel, said loop including an elongate member having a pair of ends, each of said ends being attached to said front side and being spaced from each other such that said elongate member forms said loop, said loop lying in a plane orientated generally perpendicular to said first panel;

a second panel being attached to and extending along a length of said bottom edge of said first panel, said second panel being orientated generally perpendicular said first panel and positioned below said loop; and a clip support, wherein said cup support or clip support may be selectively attached or detached from said bracket, said clip support including a central portion and a pair of legs being attached to and extending away from the central portion, said clip support having a pair of apertures extending therethrough, each of said bolts being releasably extended through one of said apertures and into one of said openings in said bracket such that said legs extend away from bracket.

* * * * *